US010429062B2

(12) United States Patent
Wells et al.

(10) Patent No.: US 10,429,062 B2
(45) Date of Patent: Oct. 1, 2019

(54) HIGH TEMPERATURE SUB-CRITICAL BOILER WITH STEAM COOLED UPPER FURNACE

(71) Applicant: The Babcock & Wilcox Company, Barberton, OH (US)

(72) Inventors: Eric L Wells, Massillon, OH (US); Roger A Detzel, Uniontown, OH (US); Albert J Bennett, Doylestown, OH (US); Steven D Thayer, Minerva, OH (US)

(73) Assignee: The Babcock & Wilcox Company, Barberton, OH (US)

( * ) Notice: Subject to any disclaimer, the term of this patent is extended or adjusted under 35 U.S.C. 154(b) by 109 days.

(21) Appl. No.: 15/091,236

(22) Filed: Apr. 5, 2016

(65) Prior Publication Data

US 2017/0284657 A1 Oct. 5, 2017

(51) Int. Cl.

| | |
|---|---|
| ***F22B 31/04*** | (2006.01) |
| ***F22B 21/34*** | (2006.01) |
| ***F22B 37/14*** | (2006.01) |
| ***F22B 35/04*** | (2006.01) |
| ***F22G 5/20*** | (2006.01) |

(52) U.S. Cl.

CPC ..... *F22B 31/04* (2013.01); *F22B 21/34* (2013.01); *F22B 35/04* (2013.01); *F22B 37/14* (2013.01); *F22G 5/20* (2013.01)

(58) Field of Classification Search

CPC ..... F22B 21/34; F22B 31/04; F22B 37/26; F22G 5/20

See application file for complete search history.

(56) References Cited

U.S. PATENT DOCUMENTS 2,131,080 A * 9/1938 Turner ..... F22G 1/00 122/481
2,310,801 A * 2/1943 Mayo ..... F22D 1/02 122/235.11
2,882,871 A * 4/1959 Koch ..... F22B 37/208 122/478
3,007,456 A * 11/1961 Murray ..... F22B 21/341 122/33
3,020,894 A * 2/1962 Rowand ..... F01K 3/183 122/33

(Continued)

FOREIGN PATENT DOCUMENTS

GB 731904 A * 6/1955 ..... F22B 21/34

OTHER PUBLICATIONS

TLV, "Wet Steam vs. Dry Steam: The Importance of the Steam Dryness Fraction", Feb. 4, 2016, https://www.tlv.com/global/US/steam-theory/wet-steam-dry-steam.html.*

*Primary Examiner* — Steven S Anderson, II
(74) *Attorney, Agent, or Firm* — Michael J. Seymour

(57) ABSTRACT

A boiler is disclosed in which the furnace is divided into a lower furnace and an upper furnace. The lower furnace uses water-cooled membrane walls, while the upper furnace uses steam-cooled membrane walls that act as superheating surfaces. A transition section is present between the lower furnace and the upper furnace. The boiler is a high temperature sub-critical natural circulation boiler which is completely top supported. The lower furnace is supported through the transition section by the upper furnace.

18 Claims, 6 Drawing Sheets

(56) References Cited

U.S. PATENT DOCUMENTS

| | | | | | |
|---|---|---|---|---|---|
| 3,215,099 | A * | 11/1965 | Coulter, Jr. | D21C 11/12 | 110/234 |
| 3,664,307 | A * | 5/1972 | Rawdon, Jr. | F22B 33/16 | 122/1 R |
| 3,818,873 | A * | 6/1974 | Watanabe | F22B 37/22 | 122/235.18 |
| 4,442,795 | A * | 4/1984 | Strohmeyer, Jr. | F22B 31/0007 | 110/245 |
| 4,479,355 | A * | 10/1984 | Guide | F01K 23/06 | 60/655 |
| 5,390,631 | A * | 2/1995 | Albrecht | F22B 29/062 | 122/235.12 |
| 6,269,754 | B1 * | 8/2001 | Ruegg | F22B 31/045 | 110/234 |
| 2010/0139535 | A1 * | 6/2010 | Gunther | F22B 37/108 | 110/322 |
| 2011/0203536 | A1 * | 8/2011 | Effert | F22B 19/00 | 122/7 R |
| 2011/0209697 | A1 * | 9/2011 | Plotkin | F24J 2/07 | 126/663 |
| 2016/0178188 | A1 * | 6/2016 | Brodesser | F22B 21/345 | 122/235.29 |

* cited by examiner

HIGH TEMPERATURE SUB-CRITICAL BOILER WITH STEAM COOLED UPPER FURNACE

BACKGROUND

The present disclosure relates to the boiler arts, with illustrative embodiments including sub-critical boilers, sub-critical natural circulation boilers, coal-fired boilers, sub-critical coal-fired boilers, sub-critical natural circulation coal-fired boilers, and to methods of manufacturing and operating the same.

Small coal-fired boilers find application in diverse settings, such as where power requirements are relatively low (e.g. rural areas, underdeveloped regions), where coal is readily available, and so forth. Typical small coal-fired boilers for electric power generation employ a sub-critical natural circulation design. An example of such a boiler design is the Babcock & Wilcox Carolina-Type Radiant Boiler design. This design employs a furnace with membraned water-cooled furnace walls that feed one or more steam drums. Water passing through the furnace walls absorb heat energy, in effect cooling the tubes/pipes directly exposed to the combustion heat. The steam drum(s) feeds one or more primary superheaters located inside a convection pass, and one or more secondary pendant superheaters located inside the upper portion of the furnace. This superheated steam is used to run a high-pressure turbine. The steam exiting the high-pressure turbine is then sent through reheaters to increase the temperature again, so that the steam can then be used to run a low-pressure turbine.

Water-cooled pipes or tubes are designed to carry wet steam (i.e. a steam/water mixture, or equivalently, steam quality less than 100%). For a given operating pressure, the temperature of wet steam is thermodynamically limited to the boiling temperature of liquid water at the given operating pressure. In practice, water-cooled pipes are designed for an operating temperature of about 650° F.-670° F., corresponding to an operating pressure of about 2200-2600 psig. In a sub-critical boiler, water-cooled pipes feed wet steam into the steam drum.

By contrast, steam-cooled pipes or tubes are designed to carry superheated steam having a steam quality of 100% (i.e., no liquid component). The temperature of superheated steam is not thermodynamically limited for a given pressure, and in Carolina-Type designs the steam-cooled superheaters generally carry superheated steam at temperatures of about 1000° F.-1050° F.

Because of the differences in temperature, water-cooled pipes can be made of lower cost carbon steel, whereas steam-cooled pipes are made of more costly steel compositions. A design such as the Carolina-Type Radiant Boiler advantageously leverages these factors by designing the entire furnace to be water-cooled, so that the membraned walls can use lower cost carbon steel pipes and connecting membranes. The higher alloy superheater components are located within the furnace and convection pass (i.e inside the walls of the boiler), and are not membraned. In such designs, the membraned water-cooled walls are generally cooler than the flue gas to which the steam-cooled superheaters are exposed, due to more efficient heat transfer to the steam/water mixture carried by the water-cooled pipes.

In certain applications, it is desirable to obtain steam at high temperatures after superheating and after reheating, e.g. about 1050° F. after both cycles. This can be difficult in small designs, and further designs and methods are needed to obtain such high temperatures.

BRIEF DESCRIPTION

The present disclosure thus relates to small high pressure sub-critical boilers that can have natural circulation and achieve high superheater temperatures of about 1050° F. Generally, the lower furnace of such boilers uses water-cooled tubes/pipes, and the upper furnace uses steam-cooled tubes/pipes. Put another way, the upper furnace of the boiler is made of superheater tubes/pipes.

Disclosed herein in various embodiments are boilers comprising: a lower furnace having water-cooled membrane walls; an upper furnace having steam-cooled membrane walls; a steam separator having a fluid inlet and a dry steam outlet; a water-cooled circuit connected to the fluid inlet of the steam separator to deliver wet steam to the steam separator, the water-cooled circuit including the water-cooled membrane walls of the lower furnace; and a steam-cooled circuit connected to the dry steam outlet of the steam separator to receive steam from the dry steam outlet, the steam-cooled circuit including the steam-cooled membrane walls of the upper furnace.

Also disclosed herein in various embodiments are boilers, comprising: a lower furnace having water-cooled membrane walls that create a sealed enclosure, the water-cooled membrane walls comprising pipes sealed by membrane disposed between and connected to the pipes; burners arranged to combust fuel to create a flue gas in the lower furnace; an upper furnace having steam-cooled membrane walls that create a sealed enclosure, the steam-cooled membrane walls comprising pipes sealed by membrane disposed between and connected to the pipes, the upper furnace arranged to receive the flue gas flowing upward out of the lower furnace; a steam separator having a wet steam inlet and a dry steam outlet; a water-cooled circuit connected to the wet steam inlet of the steam separator, the water-cooled circuit including the pipes of the water-cooled membrane walls of the lower furnace; and a steam-cooled circuit connected to the dry steam outlet of the steam separator, the steam-cooled circuit including the pipes of the steam-cooled membrane walls of the upper furnace.

Also disclosed herein in various embodiments is a method for generating superheated steam, comprising: combusting a fuel in a lower furnace of a boiler; generating wet steam from water in water-cooled membrane walls of the lower furnace; separating the wet steam into dry stream and water in a steam separator; sending dry stream to steam-cooled membrane walls of an upper furnace and the convection pass of the boiler to generate superheated steam.

These and other non-limiting aspects and/or objects of the disclosure are more particularly described below.

BRIEF DESCRIPTION OF THE DRAWINGS

The following is a brief description of the drawings, which are presented for the purposes of illustrating embodiments disclosed herein and not for the purposes of limiting the same.

DETAILED DESCRIPTION

Figure 1:
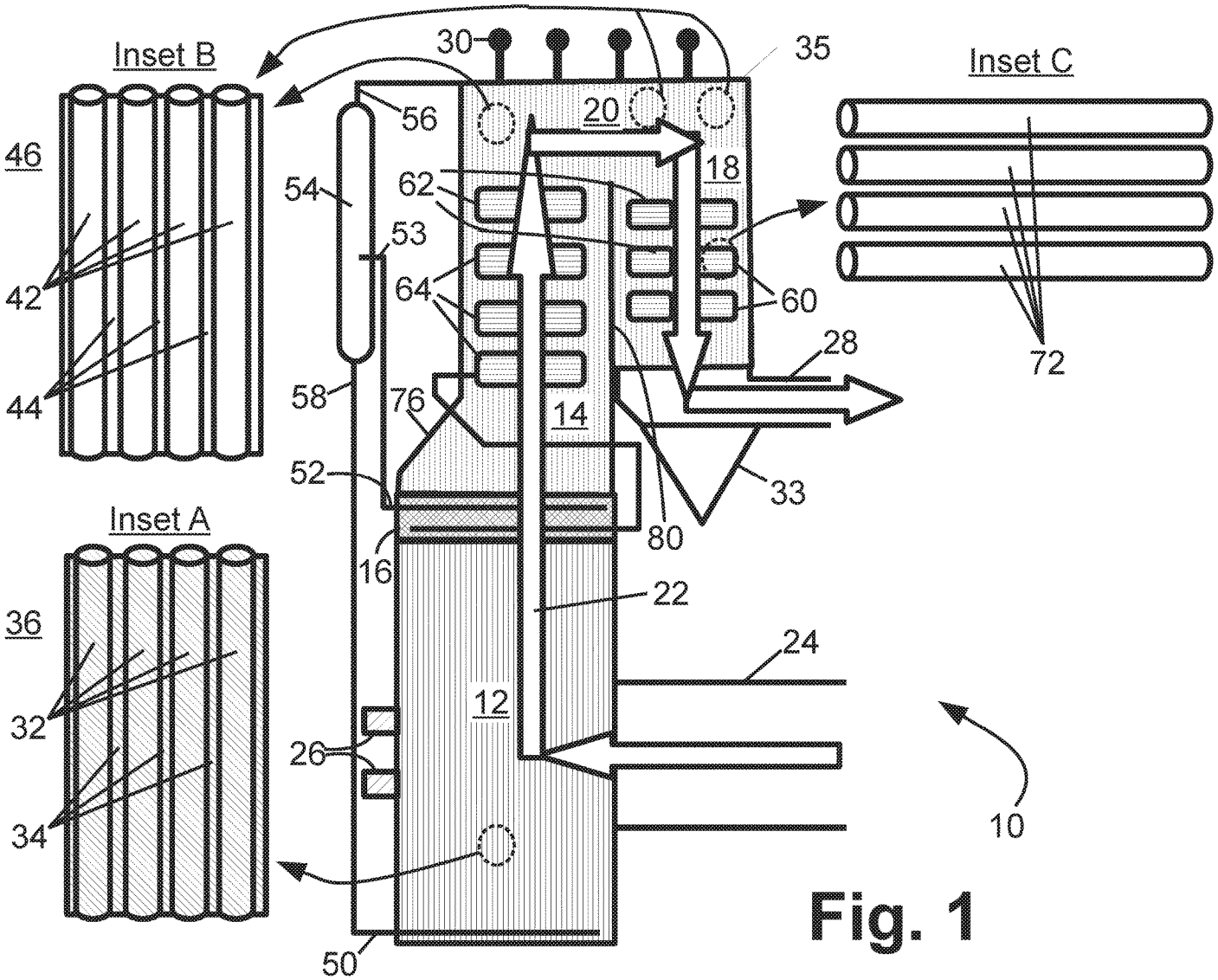
FIG. 1 diagrammatically shows a side-sectional view of an illustrative boiler. Insets A, B, and C illustrate portions of piping.

A more complete understanding of the processes and apparatuses disclosed herein can be obtained by reference to the accompanying drawings. These figures are merely schematic representations based on convenience and the ease of demonstrating the existing art and/or the present development, and are, therefore, not intended to indicate relative size and dimensions of the assemblies or components thereof.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value. For example, the term "about 2" also discloses the value "2" and the range "from about 2 to about 4" also discloses the range "from 2 to 4."

It should be noted that many of the terms used herein are relative terms. For example, the terms "inlet" and "outlet" are relative to a direction of flow, and should not be construed as requiring a particular orientation or location of the structure. The terms "upstream" and "downstream" are relative to the direction in which a fluid flows through various components, i.e. the fluid flows through an upstream component prior to flowing through the downstream component. It should be noted that in a loop, a first component can be described as being both upstream of and downstream of a second component. Similarly, the terms "upper" and "lower" are relative to each other in location, i.e. an upper component is located at a higher elevation than a lower component.

The terms "horizontal" and "vertical" are used to indicate direction relative to an absolute reference, i.e. ground level. However, these terms should not be construed to require structures to be absolutely parallel or absolutely perpendicular to each other. For example, a first vertical structure and a second vertical structure are not necessarily parallel to each other.

The terms "top" and "bottom" or the terms "roof" and "floor" are used to refer to locations/surfaces where the top/roof is always higher than the bottom/floor relative to an absolute reference, i.e. the surface of the earth. The terms "upwards" and "downwards" are also relative to an absolute reference; an upwards flow is always against the gravity of the earth.

The term "plane" is used herein to refer generally to a common level, and should be construed as referring to a volume, not as a flat surface.

A fluid at a temperature that is above its saturation temperature at a given pressure is considered to be "superheated." The temperature of a superheated fluid can be lowered (i.e. transfer energy) without changing the phase of the fluid. As used herein, the term "wet steam" refers to a saturated steam/water mixture (i.e., steam with less than 100% quality where quality is percent steam content by mass). As used herein, the term "dry steam" refers to steam having a quality equal to or about 100% (i.e., no liquid water is present).

The terms "pipes" and "tubes" are used interchangeably herein to refer to a hollow cylindrical shape, as is commonly understood.

The term "natural circulation", as used herein, refers to the circulation of water through the boiler due to differences in density as the water is heated. Water circulation can occur without the need for a mechanical pump in the water circuit between the furnace walls and the steam separator.

To the extent that explanations of certain terminology or principles of the boiler and/or steam generator arts may be necessary to understand the present disclosure, the reader is referred to *Steam/its generation and use,* 42nd Edition, edited by G. L. Tomei, Copyright 2015, The Babcock & Wilcox Company, ISBN 978-0-9634570-2-8, the text of which is hereby incorporated by reference as though fully set forth herein.

Higher wet steam pressures are not desired for many small boiler applications due to cost and safety issues (e.g. higher minimum pipe wall and membrane thicknesses). In a small boiler using only water-cooled furnace walls, it is difficult or impossible to achieve superheater and reheater outlet temperatures both at 1050° F. for 150-300 MW net power generation, because it is not possible to provide sufficient superheater/reheater surface area for heat transfer to the dry steam to obtain such high temperatures.

One possible alternative is to employ a drumless once-through boiler design, such as one of the Babcock & Wilcox Universal Pressure boiler designs. However, these designs employ once-through steam generation. In a once-through design, the transition point from wet steam to superheated steam depends on operating conditions, rather than being defined using a steam separator (e.g. a steam drum). As a result, more expensive piping is typically used for all piping/tubing in such once-through designs for safety. This results in increased capital costs.

In the sub-critical boiler designs of the present disclosure, the furnace is divided into two sections: a lower furnace using water-cooled membrane walls that feeds into the steam separator, and an upper furnace using steam-cooled membrane walls that is fed (directly or indirectly) by the dry steam outlet of the steam separator. This approach advantageously enables lower cost carbon steel to be used for the lower furnace walls, with more expensive piping being used only in the upper steam-cooled furnace (including the convection path walls in some embodiments). Cost is lowered by retaining the steam separator A higher steam output temperature is attainable because the use of a steam-cooled upper furnace and convection pass walls provides additional surface area for heat transfer from combustion/flue gases to the dry steam within the steam-cooled walls, resulting in superheated steam of desired temperatures. Again, such high superheated steam temperatures cannot be obtained with conventional water-cooled walls in the upper furnace.

In some embodiments, further improvement is attained in such a design by reducing the cross-section of the upper steam-cooled furnace compared with the lower water-cooled furnace. This increases flue gas flow velocity in the upper steam-cooled furnace compared with the lower water-cooled furnace, which provides more efficient heat transfer in the high temperature gas path, and also reduces the amount of materials and manufacturing cost.

In Carolina-Type Radiant Boiler designs, the convection pass is spaced apart from the furnace by a horizontal convection pass whose horizontal length creates a spacing between the furnace and the convection pass. As a result, in the Carolina-Type Radiant Boiler design, the furnace includes a rear wall and the convection pass includes a front wall. In a folded design, these two walls are combined into one wall. In the present disclosure, a common membraned steam-cooled wall is used to separate the upper furnace up-pass and the adjacent convection pass. This eliminates the open pass between the furnace and the convection pass, providing improved compactness for the boiler and reduces the amount of materials and manufacturing cost.

These benefits set forth above are attained by replacing the conventional water-cooled furnace with a two-part design in which the upper furnace is steam-cooled. However, such a modification has certain potential disadvantages. Overall material cost is increased due to the higher-cost alloys used in the upper furnace, but this can be mitigated by approaches disclosed herein (e.g., reduced upper furnace cross-section, employing a common steam-cooled wall between the furnace and the convection pass). Another potential disadvantage is structural complications for the preferred top-supported arrangement. This potentially arises because the lower furnace pipes are preferably carbon steel to reduce cost, while the upper furnace pipes are higher cost alloys for compatibility with steam cooling. Such a difficulty is also encountered in some once-through super-critical furnaces that employ carbon steel pipes in a lower furnace section to reduce cost. An example of such a design is the Babcock & Wilcox Spiral Wound Universal Pressure (SWUP) Boiler. In the SWUP once-through super-critical boiler design, the lower water-cooled furnace portion is top-supported via dedicated lower furnace support components that connect with the upper boiler support via an array of vertical tie rods and/or connections to the upper furnace water-cooled pipes. The resulting assembly is complicated as the lower furnace must be secured by installing its support components, followed by performing the pipe welding.

Such an approach employing dedicated lower furnace support components can also be employed in sub-critical boiler designs with an upper steam-cooled furnace and lower water-cooled furnace, as disclosed herein. However, in some embodiments disclosed herein, such dedicated support castings and concomitant complex pipe welding operations are eliminated, and in their place a transition section with integral transition piping is employed. In the transition section, at least some transition pipes are designed to be vertically oriented pipes, and lower furnace support is achieved by tensile support via welds to these vertically oriented transition pipes. The transition section can be made of a cast stainless steel material that is compatible with steam-cooling—it is therefore overdesigned for the water-cooled transition pipes, but the ability to maintain top support for the lower furnace outweighs the additional cost entailed by overdesigning these relatively short water-cooled transition pipes. The transition section also acts as a pressure seal between the furnace and the atmosphere.

Some illustrative embodiments of such sub-critical boilers are diagrammatically shown and described below. These are merely illustrative examples, and a given embodiment may include one, two, more, or all disclosed novel features described herein.

Figure 2:
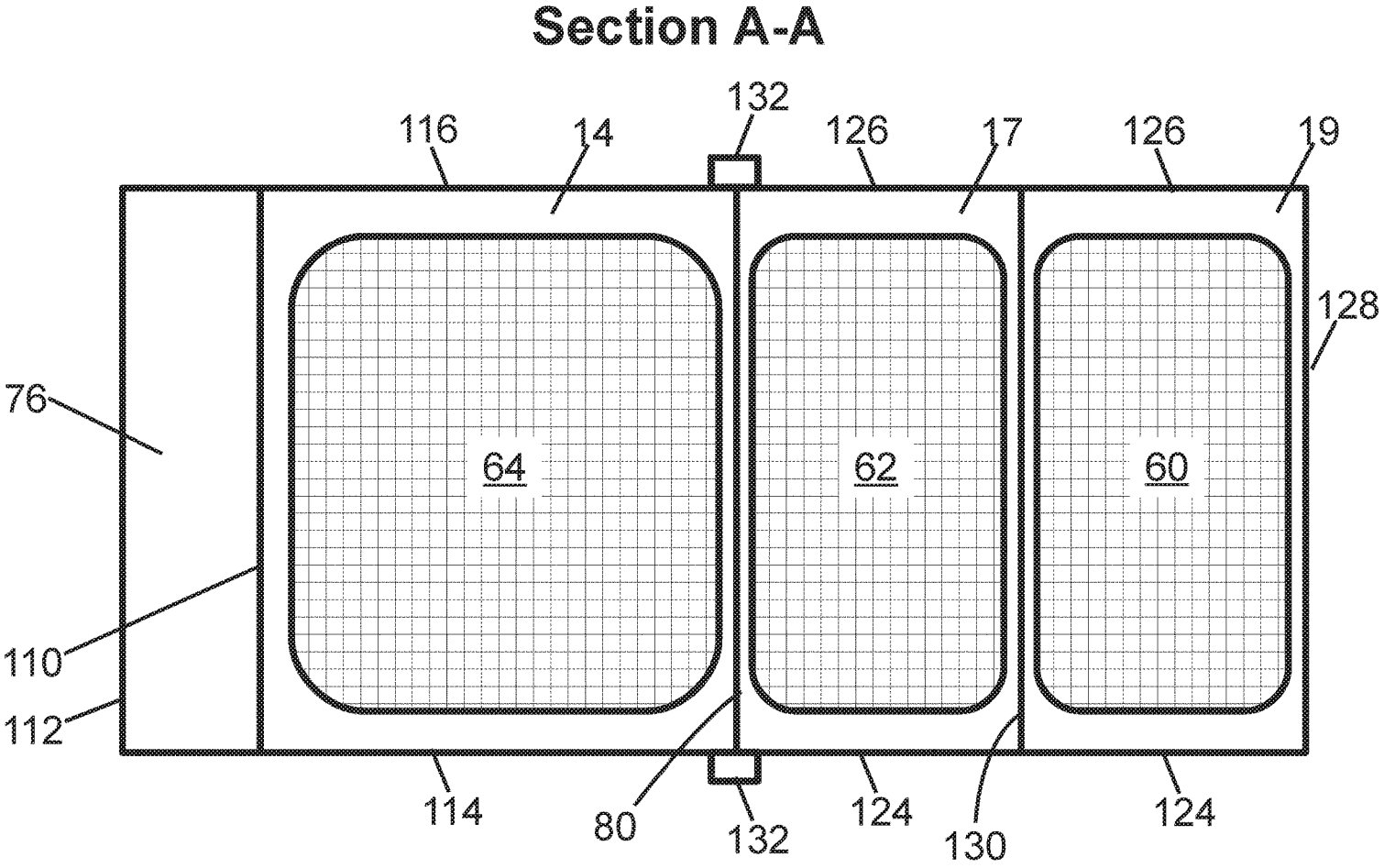
FIG. 2 is a top cross-sectional view of the boiler of FIG. 1 through the upper furnace along line A-A of FIG. 3.

FIG. 1 and FIG. 2 show different views of an illustrative sub-critical natural circulation boiler of the present disclosure. FIG. 1 is a side-sectional view of the entire boiler. FIG. 2 is a top (plan) view that passes through the upper furnace of the boiler.

With reference to FIG. 1, a sub-critical boiler 10 is diagrammatically shown. The boiler 10 includes a lower furnace 12 which is water-cooled, an upper furnace 14 which is steam-cooled, and a transitional section 16 which in preferred embodiments is formed from a transition casting. The illustrative boiler 10 is a folded boiler design that further includes a convection pass 18 which is connected to the upper furnace 14 to form what might be considered a horizontal pass 20. The walls of the lower furnace 12, the transitional section 16, the upper furnace 14, and the convection pass 18 collectively define a boiler.

Combustion/flue gas 22 are diagrammatically indicated by arrows, and these gases flow through the boiler and heat the water/steam in the various walls of the boiler. More specifically, combustion air is blown into the lower furnace 12 through an air inlet 24, where it is mixed with a combustible fuel such as coal, oil, or natural gas. In some preferred embodiments, the fuel is coal, which is pulverized by a pulverizer (not shown). A plurality of burners 26 combusts the fuel/air mixture, resulting in flue gas. The flue gas rises by natural convection through the up-pass formed by the lower furnace 12, the transition section 16, and the upper furnace 14, then flows horizontally through the convection pass, which includes the convection pass 18 and finally exits through a flue gas outlet 28 for further downstream processing. Preferably, a hopper 33 is provided to capture ash or other contaminants in the exiting flue gas.

The sub-critical boiler 10 is top-supported to the building structure via suitable upper anchor points 30. These are diagrammatically indicated in FIG. 1. The pipes of the upper furnace 14 and the convection pass 18 are vertically oriented and are directly supported from the anchor points 30. The pipes of the lower furnace 12 are also vertically oriented and are directly supported via welds to the transition section 16.

It is desirable to capture the heat energy present in the combustion/flue gas 22 for tasks such as driving an electrical power generation turbine (for example). To do so, the sub-critical boiler 10 includes cooling surfaces comprising pipes or tubes through which wet steam flows (these pipes or tubes are referred to herein as water-cooled) or through which superheated steam flows (these pipes or tubes are referred to herein as steam-cooled). More particularly, with reference to Inset A of FIG. 1, the lower furnace 12 includes water-cooled tubes 32 with membrane 34 disposed between and welded to the tubes 32, so that the tubes 32 and membrane 34 collectively form a membrane wall 36, with the tubes 32 carrying flow of wet steam through the membrane wall 36. The membrane wall 36 forms the barrier that contains the flue gas 22, i.e. the membrane 34 is welded or otherwise connected to the tubes 32 to provide a seal against leakage of the flue gas 22. The water-cooled membrane wall 36 of the lower furnace 12 does not see highly elevated water temperatures; for example, if the sub-critical boiler 10 is designed for a maximum steam pressure of 2800 psig, then the saturated steam carried by the water-cooled tubes 32 is at about 685° F. (corresponding to the boiling point of water at 2800 psig), though of course the combustion gas is at a much higher temperature.

The upper furnace 14 and convection pass 18 are analogously made of a steam-cooled membrane wall 46 comprising steam-cooled tubes 42 with membrane 44 disposed between and welded or otherwise connected to the tubes 42 (see Inset B of FIG. 1), with the tubes 42 and membrane 44 collectively forming the membrane wall 46. The tubes 42 carry a flow of superheated steam through the membrane wall 46. The steam-cooled membrane wall 46 carries steam at substantially higher steam temperatures than the water-cooled membrane wall 36. For example, the steam in the steam-cooled membrane walls 46 may be at a temperature of over 1000° F., e.g. up to 1100° F. in some contemplated embodiments. It should be noted that the roof 35 of the furnace and the convection pass is also made of steam-cooled membrane wall. It should also be noted that the diameter of the tubes and the spacing between the tubes of the steam-cooled membrane walls may differ between the upper furnace and the convection pass.

The tubes 32 of the water-cooled membrane wall generally have a greater diameter than the tubes 42 of the steam-cooled membrane wall. In particular, embodiments, the inner diameter of the water-cooled tubes is at least 0.5 inches greater than the inner diameter of the steam-cooled tubes. The tubes of the water-cooled membrane wall have an inner diameter of about 1.5 inches to about 2.0 inches, while the tubes of the steam-cooled membrane wall have an inner diameter of about 1.0 inches to about 2.5 inches. The tubes of the water-cooled membrane wall have an outer diameter of about 2.0 inches to about 2.5 inches, while the tubes of the steam-cooled membrane wall have an outer diameter of about 1.3 inches to about 2.3 inches. The tubes themselves may have a thickness of about 0.2 inches to about 0.5 inches.

In a typical steam flow circuit for the sub-critical boiler 10, water is inputted to the lower ends of the water-cooled tubes 32 via a lower inlet header 50. As the water travels upwards through these water-cooled tubes 32, the water cools the tubes exposed to high-temperature flue gas in the lower furnace 12 and absorbs energy from the flue gas to become a steam-water mixture (i.e. wet steam) at subcritical pressure.

The wet steam exits the upper ends of the water-cooled tubes 32 and flows via a wet steam outlet header 52 into a fluid inlet 53 of a steam separator 54. The wet steam outlet header 52 is preferably welded to water-cooled transition pipes within the transition section 16. Preferably, the wet steam outlet header 52 facilitates venting of the tubes 32 as appropriate during start up, shut down, or maintenance, etc. Any type of steam separator may be used, e.g. employing cyclonic separation or so forth. In particular embodiments, a vertical steam separator is used, such as that described in U.S. Pat. No. 6,336,429. A dry steam outlet 56 of the steam separator 54 at an upper end of the steam separator outputs substantially dry steam (i.e., steam with 100% quality). A drain or water outlet 58 near the lower end of the steam separator 54 collects water extracted from the wet steam for recycle back to the lower inlet header 50 feeding the lower furnace 12.

The steam output from the dry steam outlet 56 flows to the convection pass 18 and then to the upper furnace 14. To provide additional surface for heat transfer, one or more primary superheaters 60, re-heaters 62, and/or secondary superheaters 64 may be provided in the interior volume of the boiler, within the upper furnace 14 and the convection pass 18. As illustrated here, one or more superheaters 60 disposed in the convection pass 18; one or more re-heaters (or re-heating superheaters) 62 are disposed in the convection pass 18 and/or in the upper furnace 14; and one or more secondary superheaters 64 are disposed in the upper furnace 14. Again, the steam-cooled furnace walls 46 of the upper furnace 14 act as superheater surfaces as well. A more detailed illustrative steam circuit is described in later drawings. It is to be understood that the illustrative steam circuit is merely an example, and other steam circuit configurations are contemplated, e.g. various superheater components may be omitted, and/or located elsewhere, etc.

Unlike the membrane walls 46 of the steam-cooled upper furnace 14 and the convection pass 18, the superheaters 60, 62, 64 located within the boiler are formed from loose pipes/tubes 72 without membranes joining the tubes together (see Inset C of FIG. 1). These superheaters 60, 62, 64 are disposed in the interior of the flue boiler, and desirably permit flue gas to pass through them, increasing the surface area through which heat transfer from the flue gas to the steam within the pipes can occur. The superheater pipes 72 are preferably made of aan alloy steel material. In some embodiments, the superheater pipes 72 and the steam-cooled membrane wall 46 are made of the same alloy steel material, although this is not required.

As seen in FIG. 1, the superheaters 60, 62, 64 are surrounded by the steam-cooled membrane walls 46. Said another way, the superheaters 60, 62, 64 are contained within the upper furnace 14 and/or in the convection pass 18 as shown in the illustrative boiler 10 of FIG. 1. The steam within the steam-cooled membrane walls 46 may be at the same or higher temperature than in the superheaters 60, 62, 64. Due to the additional surface area available for heat transfer from the flue gas to the superheated steam within the various superheating surfaces 46, 60, 62, 64, the boiler 10 can achieve higher superheated steam temperatures than would be achievable with a conventional water-cooled sub-critical boiler whose furnace walls are entirely cooled by wet steam flowing through water-cooled pipes. However, the sub-critical boiler 10 retains the general layout of a sub-critical boiler, including employing the steam separator 54 disposed (in a steam flow sense) between the wet steam sub-circuit and the superheated steam sub-circuit, thus retaining advantages such as the operational flexibility of a sub-critical boiler design.

The illustrative sub-critical boiler 10 employs certain features that enhance compactness and efficiency. One feature is a reduced cross-sectional area for the combustion/flue gas flow 22 through the upper furnace 14 compared with the lower furnace 12. The referenced cross-sectional area is the horizontal cross-section in the illustrative design in which the flue gas 22 flows vertically upward. In the illustrative boiler 10, the reduction in cross-sectional area of the upper furnace 14 relative to the lower furnace 12 is obtained via a "arch" surface 76, which is slanted as the upper furnace continues upward from the transition section 16, to reduce turbulence at the transition to higher flow velocity. This has at least two benefits. First, the reduced cross-sectional area of the upper furnace 14 reduces the amount of material (e.g. total surface area of membrane wall 46) which reduces capital cost. Second, the higher velocity of the flue gas flow 22 due to the reduced cross-sectional area increases the efficiency of heat transfer to the steam-cooled pipes 42, 72. The transition section 16 is located below the arch surface 76. The arch 76 is part of the upper furnace, and is also a steam-cooled membrane wall.

FIG. 2 is a cross-sectional plan (top) view of the boiler 10 through the upper furnace 14, and provides another view of the various components. The front wall 110 of the upper furnace is shown in solid line, as is the front wall 112 of the lower furnace. The area between these two walls is the arch 76. The upper furnace includes a first side wall 114 and a second side wall 116 opposite the first side wall, both of which are made of steam-cooled membrane walls 42. The fourth side of the upper furnace is defined by a common steam-cooled membrane wall 80. The convection pass is defined by a first side wall 124, a second side wall 126 opposite the first side wall, and a rear wall 128. A baffle wall 130 divides the convection pass into a front convection pass 17 and a rear convection pass 19. A primary superheater 60 is seen in the rear convection pass 19, while a reheater 62 is seen in the front convection pass 17 and a secondary superheater 64 is seen within the upper furnace 14.

Another feature that enhances the compactness and efficiency of this boiler design is the use of a common steam-cooled membrane wall 80. The common steam-cooled membrane wall 80 is both a "rear" wall of the upper furnace 14 and a "front" wall of the convection pass 18. The upper furnace 14 and the convection pass 18 thus share the common steam-cooled membrane wall 80, which comprises a single layer of pipes sealed by a single layer of membrane disposed between and connected to the single layer of pipes. The use of the common steam-cooled membrane wall 80 has numerous advantages. The usual open pass between the furnace and the convection pass is eliminated, providing a more compact design and reducing capital costs due to lower surface area. The common steam-cooled membrane wall 80 is advantageously heated both by flue gas flowing upward through the upper furnace 14 and by flue gas flowing downward through the convection pass 18.

One issue with employing the common steam-cooled membrane wall 80 is the large temperature variation between the flue gas temperature in the upper furnace 14, on the one hand, and the flue gas temperature in the convection pass 18 on the other hand. This differential between the two flue gas temperatures will be felt by the common steam-cooled membrane wall 80. Using transient modeling and finite element analysis to determine the resulting stress in the walls of the boiler, it was found that maximum thermal differential stress occurs during start-up, and more particularly occurs in a small area about the bottom of the common steam-cooled membrane wall 80 adjacent walls 114, 124 on one side and walls 116, 126 on the other. Intuitively, this can be understood since this bottommost part of the common steam-cooled membrane wall 80 is where there is the greatest temperature differential between the upward flue gas flow in the upper furnace 14 and the downward flue gas flow in the convection pass 18. This stress can cause boiler bowing/tearing, and is accommodated by providing seals at the junction of the bottom of the common steam-cooled membrane wall 80, the furnace side walls 114, 116, and the convection pass side walls 124, 126, as analysis showed that the overstressed area does not extend significantly up the common steam-cooled membrane wall 80. These seals are illustrated in FIG. 2 with reference numeral 132.

It should be noted that the various improvements disclosed herein can be used to advantage individually or in various combinations, and/or in various types of boilers. For example, the disclosed common steam-cooled membrane wall 80 can also be used to advantage in a once-through boiler design having a convection pass, or in other types of boilers having two neighboring steam-cooled membrane walls.

Figure 3:
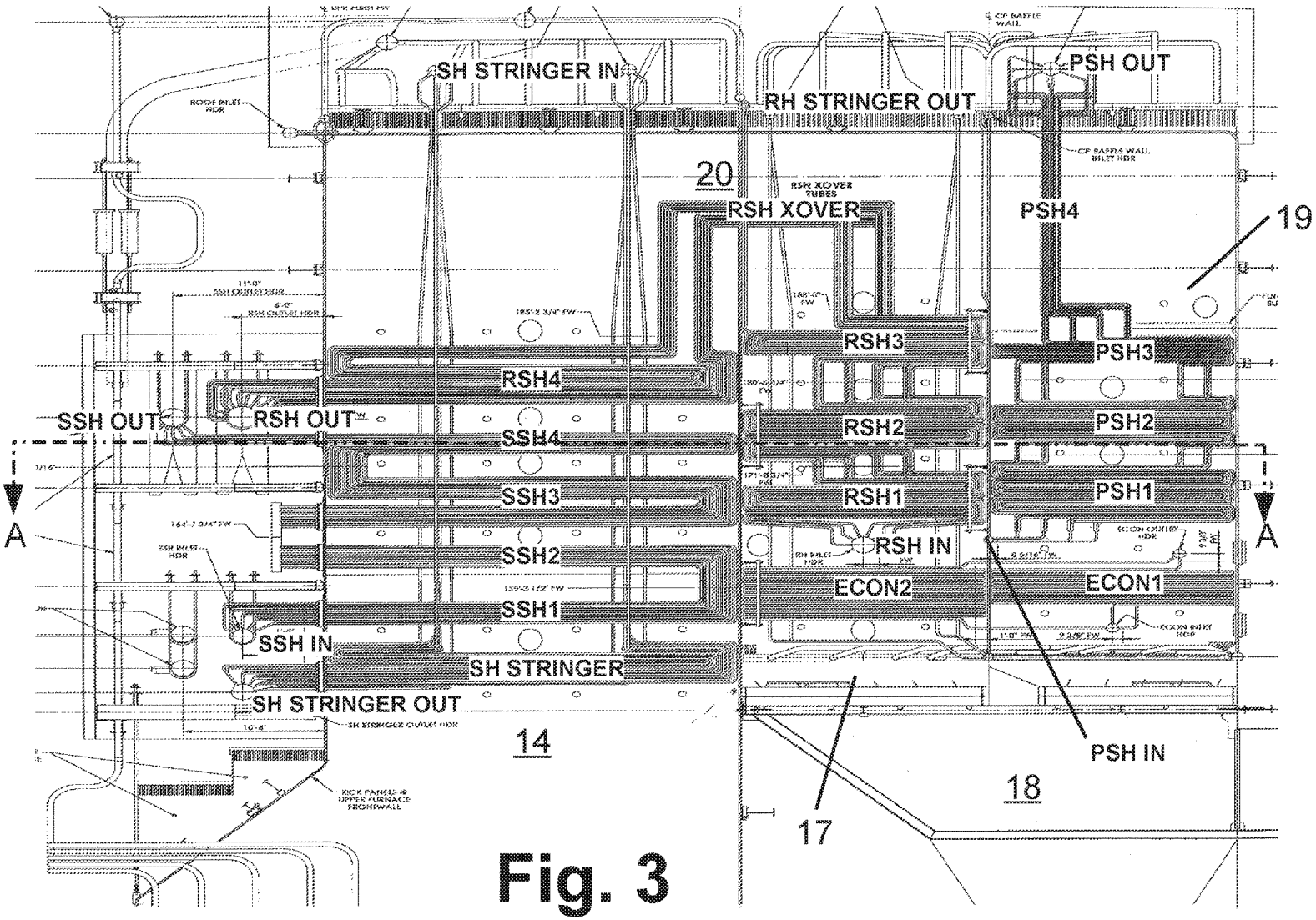
FIG. 3 diagrammatically shows a more detailed side-sectional view of a portion of the boiler of FIG. 1 including an illustrative layout of superheaters.
Figure 4:
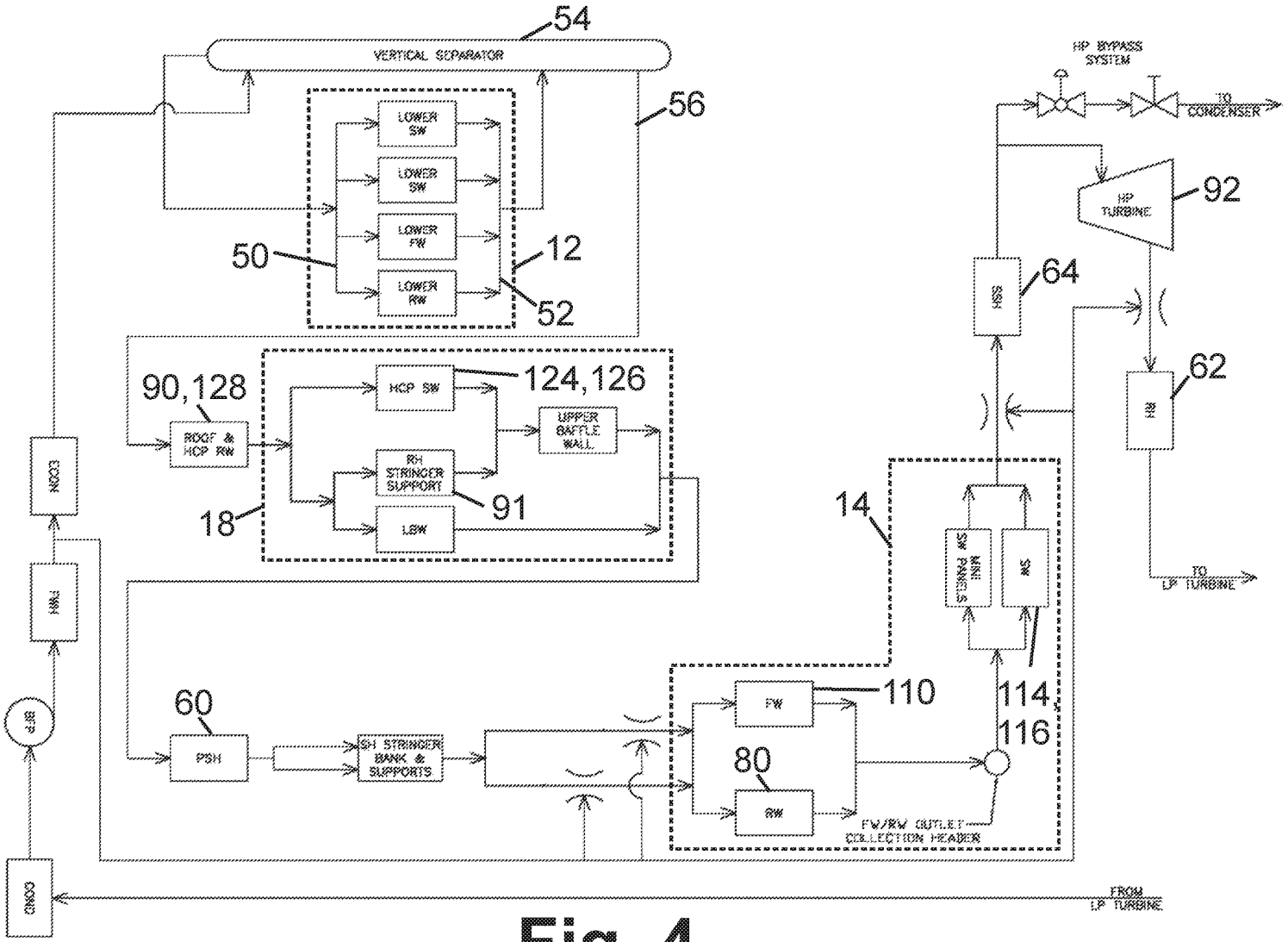
FIG. 4 diagrammatically shows a cooling circuit of the boiler of FIG. 1 and FIG. 2.

With reference now to FIGS. 2-4, an illustrative steam-cooled circuit is described that may be used in the boiler 10 of FIG. 1. FIG. 3 shows a side-sectional view of the upper furnace 14, the convection pass 18, and the horizontal pass 20 connecting them. Also shown are more detailed renderings of the primary superheaters 60, reheaters 62, and secondary superheaters 64. In FIG. 3 and FIG. 4, the primary superheaters 60 are labeled using the prefix "PSH"; the reheaters (i.e. re-heating superheaters) are labeled using the prefix "RSH"; and the secondary superheaters aeare labeled using the prefix "SSH". Additionally, economizers are shown, indicated by the prefix "ECON". Inlet headers are indicated by the suffix "IN" while outlet headers are indicated by the suffix "OUT".

As shown in FIG. 3, there are four primary superheaters disposed in the rear convection pass 19. Three of these employ horizontal tubes, and from lowest to highest elevation are indicated as PSH1, PSH2, and PSH3. The fourth primary superheater PSH4 is at the highest elevation and employs vertical pipes. Flow through the primary superheaters is in sequential order by number, upward through the convection pass, and the superheated steam exits at the PSH OUT header at the roof of the boiler.

Four reheaters RSH1, RSH2, RSH3, and RSH4 are also employed. Three of these (RSH1, RSH2, and RSH3) are disposed in the front convection pass 17, while the fourth reheater RSH4 is disposed near the top of the upper furnace 14. Cross-over piping labeled RSH XOVER conveys steam from RSH3 in the convection pass 18 to RSH4 in the upper furnace 14. Steam flow is from a lower inlet header RSH IN, through the reheaters in sequential order, to an outlet header RSH OUT shown to the left of the upper furnace 14 in FIG. 3.

Four secondary superheaters SSH1, SSH2, SSH3, and SSH4 are disposed in the upper furnace 14 below the fourth re-heater RSH4. Superheated steam flows from the PSH OUT header to the SSH IN header shown to the left of the upper furnace 14, then upwards successively through SSH1, SSH2, SSH3, and SSH4 and to the SSH OUT header again shown to the left of the upper furnace 14 above the SSH IN header.

The steam-cooled circuit further includes superheater stringers denoted SH STRINGER in FIG. 3, which are fed from SH STRINGER IN headers at the top of the upper furnace and subsequently flow to the SH STRINGER OUT outlet header. These stringers support the secondary superheaters. Similarly, reheater stringers are visible which support the reheaters in the front convection pass.

Referring now to FIG. 4, a more detailed illustration of the components that form the steam-cooled circuit and their interconnections is shown. The steam-cooled circuit starts at the dry steam outlet 56 of the steam separator 54. Going downstream from the steam separator, dry steam running downstream first flows from the dry steam outlet 56 across the roof 90 of the boiler 10. Dry steam also flows down the rear wall 128 of the convection pass 18. The dry steam that flowed down the rear wall 128 then flows up the convection pass side walls 124, 126 and the reheater stringer supports 91, and then back down the upper baffle wall. The dry steam from the roof 90 of the boiler flows up the lower baffle wall.

The two dry superheated steam streams from the upper baffle wall and the lower baffle wall are then combined and flow into the primary superheaters 60 (i.e. PSH1, PSH2, PSH3, PSH4 in FIG. 3). Please note the superheated steam travels through all four primary superheaters; the steam is not divided so that only a portion flows through each primary superheater. The superheated steam travels upwards to the PSH OUT header (see FIG. 3). The superheated stream then travels downwards through the superheater stringers (labeled SH STRINGER) in the upper furnace. From there, the superheated stream travels upwards through the upper furnace front wall 110 and the common steam-cooled membrane wall 80 (acting as the upper furnace rear wall). The superheated steam then travels upwards through the upper furnace side walls 114, 116. Next, the superheated steam travels upwards through the secondary superheaters 64. Again, the superheated steam passes through all four secondary superheaters (SSH1, SSH2, SSH3, and SSH4). After passing through the secondary superheaters, the superheated steam has a pressure of 2000 psig or greater, and in some cases 2500 psig or greater, such as about 2600 psig. The superheated steam also has a temperature of 1000° F. or greater, such as about 1050° F. The superheated steam is then sent to a high-pressure turbine 92 where the heat energy is used for electrical power generation. The superheated steam loses both temperature and pressure within the high-pressure turbine 92. The output from the high-pressure turbine is then sent back to the boiler 10 and sent through the reheaters 62. After passing through the reheaters, the steam has a pressure of 500 psig or greater, such as about 600 psig, and also has a temperature of 1000° F. or greater, such as about 1050° F. This superheated steam can then be used to run a low-pressure turbine.

Referring back to FIG. 4, water is returned from the low-pressure turbine. This water passes through a condenser (COND), a boiler feed pump (BFP), and a feedwater heater (FWH) before being sent to the economizer (ECON) to absorb residual heat energy from the flue gas exiting the convection pass. From there, the heated water from the economizer is sent to the steam separator 54. In the water-cooled circuit, water is sent from the steam separator to lower furnace inlet header 50, which feeds the water-cooled membrane walls of the lower furnace 12. Wet steam is collected from lower furnace outlet header 52 and sent to the steam separator 54 for separation into water and dry steam.

The steam-cooled circuit of FIG. 3 and FIG. 4 is merely an illustrative example, and in other embodiments the number and locations of superheaters may be different, as well as the arrangement of the various steam-cooled membrane wall and superheater components in the steam-cooled circuit. The illustrative furnace of FIG. 1 with the illustrative steam-cooled steam circuit of FIG. 3 and FIG. 4 has been modeled using 3D solid modeling software, and was determined from this analysis to provide improved performance including a 1050° F./2600 psig superheater temperature/pressure and a 1050° F./600 psig reheater temperature/pressure, for a boiler designed to provide 150 MW to 300 MW of net power.

One potential issue with the furnace design of FIG. 1 is that during start-up, there is no steam passing through the steam-cooled membrane walls of the upper furnace. When the boiler 10 is first fired, the hot flue gas flows across these steam-cooled membrane walls. During steady-state operation, the dry steam within the membrane walls would absorb heat energy, thus reducing the temperature of the pipes and membrane of the membrane wall, as well as reducing the temperature of the flue gas. During start-up, though, there is very little steam throughout the boiler. As a result, the thermal stresses on the steam-cooled membrane walls of the upper furnace are greater than during steady-state operation.

Figure 5:
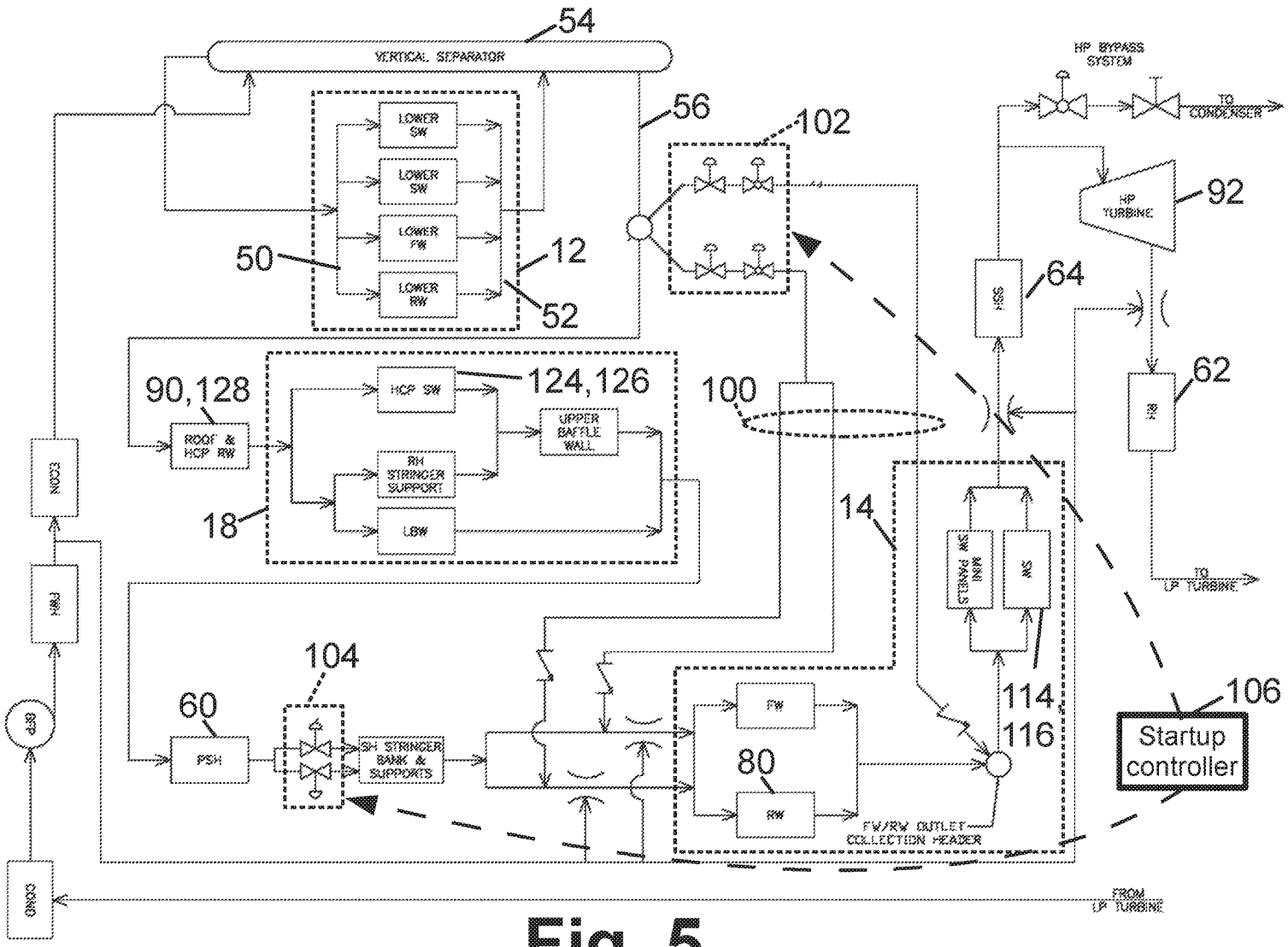
FIG. 5 diagrammatically shows the cooling circuit of FIG. 4 with start-up control circuitry as described herein.

FIG. 5 illustrates a steam circuit that provides a solution to this start-up thermal stressing problem, which leverages the dry steam output at the dry steam outlet 56 of the steam separator 54. This dry steam is not yet superheated. As seen in FIG. 5, the start-up circuitry of the steam circuit includes a valved diversion path 100 that connects the dry steam outlet 56 of the steam separator 54 more directly to the steam-cooled membrane walls of the upper furnace 14. The valved diversion path 100 is valved with one or more diversion valves 102 (four are shown here). The diversion path 100 diverts flow from the dry steam outlet 56 of the steam separator 54 to the steam-cooled membrane walls of the upper furnace 14. The start-up circuitry further includes one or more reduction valves 104 (two are shown here) located in the steam-cooled circuit downstream of the primary superheaters 60. A startup controller 106, e.g. a computer or other electronic control device, operates the valves 102, 104 to establish: (1) a start-up mode in which diversion valves 102 are opened to open the diversion path 100 and reduction valves 104 are closed (fully or partially as desired) to reduce flow through the partially bypassed primary superheaters 60 and convection pass 18; or (2) a normal operating mode in which diversion valves 102 are closed to shut off the diversion path 100 and reduction valves 104 are open to allow full flow through the primary superheaters 60 and the convection pass 18.

When the diversion valves 102 are open and reduction valves 104 are partially closed, because the upper furnace walls provide the lowest path of resistance to flow, the dry steam will tend to flow through the upper furnace walls instead of through the roof and convection pass. The presence of the dry steam in the upper furnace walls will protect the tubes of the upper furnace from excessive temperature differential, and will also cool the flue gas. As a result, the passage of flue gas through the convection pass 18 will not excessively stress the walls of the convection pass, even though dry steam is not present in large amounts in these steam-cooled walls during startup.

Heated flue gas also flows over the steam-cooled membrane walls of the convection pass 18; however, the flue gas will have cooled substantially by this point, so the primary start-up thermal stresses arise in the upper furnace 14.

Figure 6:
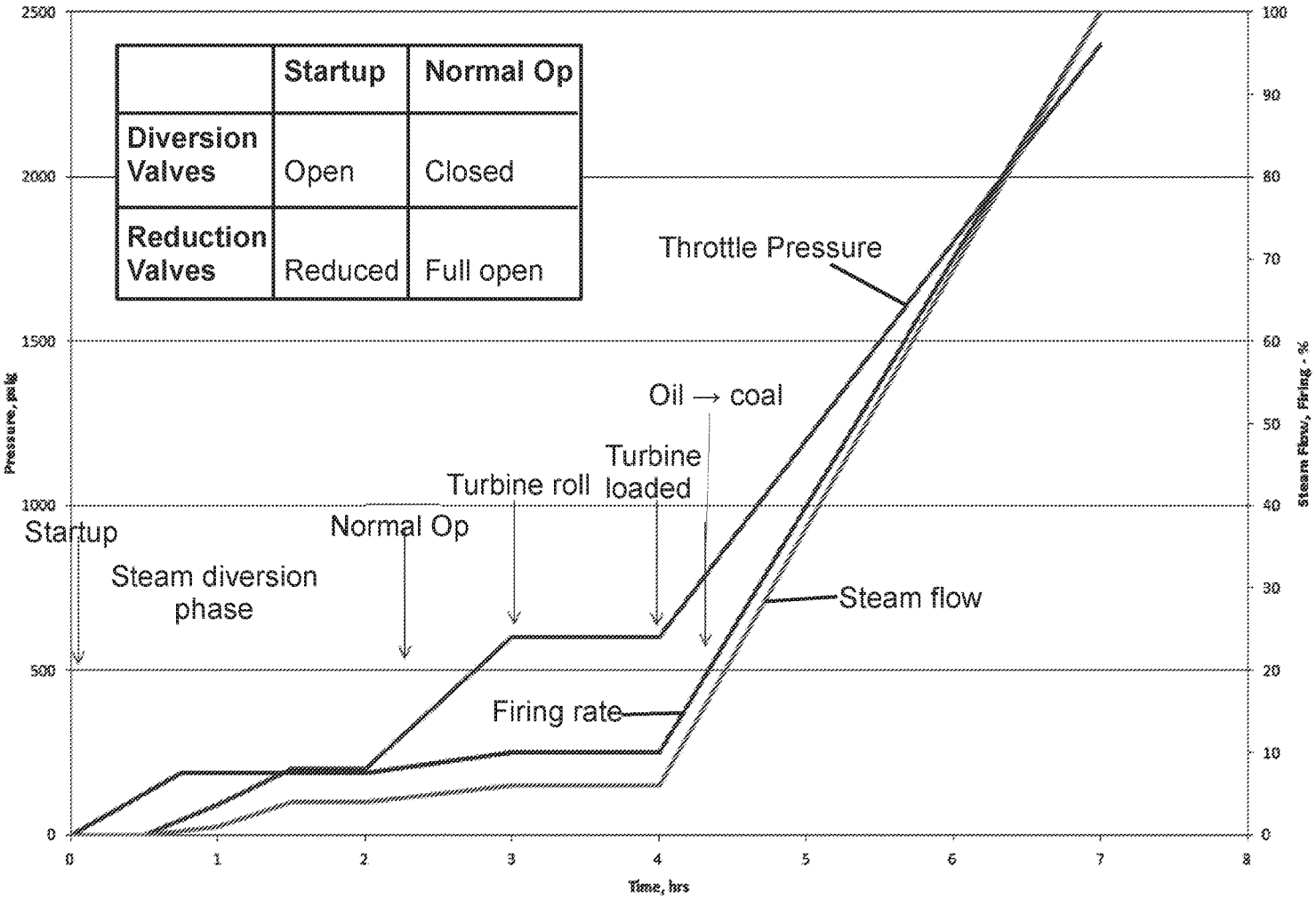
FIG. 6 diagrammatically plots a typical start-up sequence performed using the circuitry of FIG. 5. The inset table shows start-up circuitry valve settings for the start-up and normal operating modes. The x-axis is time in hours, and runs from 0 to 8 in intervals of 1. The left-hand y-axis is the pressure in psig, and runs from 0 to 2500 in intervals of 500. The right-hand y-axis is the steam flow and firing %, and runs from 0 to 100 in intervals of 10. There are three lines for throttle pressure, firing rate, and steam flow. The throttle pressure is read against the left-hand y-axis, and the firing rate and steam flow are read against the right-hand y-axis.

With continuing reference to FIG. 5 and with further reference to FIG. 6, a typical startup sequence is shown. The diversion valves 102 may in some embodiments be adjusted based on a thermocouple temperature reading at the outlet headers of the upper furnace walls, so that a temperature limit for the walls is not exceeded. For typical membrane walls, the use limit is about 1000° F., so the dry steam from the separator outlet 56 is sufficient to cool the membrane walls.

In FIG. 6, the firing rate indicates the relative amount of heat being generated by the boiler. The boiler is run at about 10% for four hours using oil before the boiler is ramped up to 100% capacity. This permits the formation of steam sufficient to fill the steam-cooled tubes. For the first two hours, the steam diversion path 100 is open, and afterwards is closed to permit steam to fill the walls of the convection pass. After four hours, the high-pressure turbine is fully loaded as well, and the fuel is switched to coal. The firing rate, steam flow, and throttle pressure are then increased to their steady-state operating values.

Advantageously, the supply of steam for start-up using this approach comes from the steam separator 54. This allows the boiler 10 to be put in service without the use of auxiliary steam and/or an auxiliary steam boiler. It will again be appreciated that the disclosed approach for cooling membrane walls during start-up may be employed in a wide range of boilers besides the illustrative boiler 10 of FIG. 1.

The present disclosure as been described with reference to exemplary embodiments. Obviously, modifications and alterations will occur to others upon reading and understanding the preceding detailed description. It is intended that the present disclosure be construed as including all such modifications and alterations insofar as they come within the scope of the appended claims or the equivalents thereof.

We claim:

1. A boiler, comprising:

a lower furnace having water-cooled membrane walls;

an upper furnace having steam-cooled membrane walls and located above the lower furnace, wherein flue gas passes from the lower furnace to the upper furnace, and wherein the steam-cooled membrane walls of the upper furnace include a front wall, a rear wall, and side walls;

a convection pass downstream of the upper furnace, the convection pass having steam-cooled convection pass membrane walls and extending downwards, wherein the steam-cooled convection pass membrane walls of the upper furnace include a front wall, a rear wall, and side walls;

wherein the upper furnace and the convection pass share a common steam-cooled membrane wall, the common steam-cooled membrane wall being both the rear wall of the upper furnace and the front wall of the convection pass;

a baffle wall that divides the convection pass into a front convection pass and a rear convection pass;

a primary superheater in the rear convection pass;

a secondary superheater disposed inside the upper furnace;

a steam separator having a fluid inlet and a dry steam outlet;

a water-cooled circuit connected to the fluid inlet of the steam separator to deliver wet steam to the steam separator, the water-cooled circuit including the water-cooled membrane walls of the lower furnace; and a steam-cooled circuit connected to the dry steam outlet of the steam separator to receive dry steam from the dry steam outlet, the steam-cooled circuit running sequentially from the dry steam outlet through the rear wall of the convection pass, the side walls of the convection pass, the baffle wall, through the primary superheater, through the upper furnace front wall and the common steam-cooled membrane wall, then through the upper furnace side walls, and through the secondary superheater.

2. The boiler of claim 1, wherein the water-cooled circuit including the water-cooled membrane walls of the lower furnace comprise carbon steel; and the steam-cooled circuit including the steam-cooled membrane walls of the upper furnace comprise alloy steel.

3. The boiler of claim 2, wherein the pipes of the water-cooled membrane walls of the lower furnace have upper ends fluidly connected to the fluid inlet of the steam separator and have lower ends fluidly connected to a water outlet of the steam separator.

4. The boiler of claim 3, further comprising a transition section disposed between the upper furnace and the lower furnace, wherein the upper furnace is top-supported and the lower furnace is top-supported by the upper furnace.

5. The boiler of claim 4, wherein a horizontal cross-sectional area of the upper furnace is smaller than a horizontal cross-sectional area of the lower furnace.

6. The boiler of claim 5, wherein the upper furnace includes a slanted surface transitioning from the larger cross-sectional area of the lower furnace to the smaller cross-sectional area of the upper furnace.

7. The boiler of claim 6, wherein the secondary superheater disposed inside the upper furnace comprises pipes without membrane.

8. The boiler of claim 7, wherein the steam-cooled convection pass membrane walls comprise pipes sealed by membrane disposed between and connected to the pipes.

9. The boiler of claim 8, wherein the primary superheater disposed inside the convection pass comprises pipes without membrane.

10. The boiler of claim 9, wherein the water-cooled membrane walls of the lower furnace comprise water pipes, the steam-cooled membrane walls of the upper furnace comprise steam pipes, and the water pipes have a diameter greater than a diameter of the steam pipes.

11. The boiler of claim 10, wherein the boiler is a natural circulation boiler.

12. A method for generating superheated steam, comprising:

combusting a fuel in a lower furnace of a boiler, wherein an upper furnace is located above the lower furnace, and flue gas passes from the lower furnace to the upper furnace and then through a convection pass;

wherein the upper furnace includes a front wall, a rear wall, and side walls;

wherein the convection pass includes a front wall, a rear wall, and side walls;

wherein the upper furnace and the convection pass share a common wall, the common wall being both the rear wall of the upper furnace and the front wall of the convection pass;

wherein the boiler further includes a baffle wall that divides the convection pass into a front convection pass and a rear convection pass;

generating wet steam from water in water-cooled membrane walls of the lower furnace;

separating the wet steam into dry steam and water in a steam separator;

sending dry steam sequentially through the convection pass rear wall, the convection pass side walls, the baffle wall, through a primary superheater in the rear convection pass, through the upper furnace front wall and the common wall, then through the upper furnace side walls, and through a secondary superheater.

13. The method of claim 12, further comprising top-supporting the lower furnace by suspension from the upper furnace through a transition casting.

14. The method of claim 13, further comprising accelerating a velocity of flue gas in the upper furnace by reducing a horizontal cross-sectional area of the upper furnace compared to a horizontal cross-sectional area of the lower furnace to increase heat transfer efficiency.

15. The method of claim 12, wherein the superheated steam has a temperature of at least 900° F.

16. The method of claim 15, further comprising draining water separated from the wet steam by the steam separator into the lower furnace.

17. The method of claim 16, wherein the fuel that is combusted in the lower furnace is coal.

18. The boiler of claim 1, wherein the upper furnace does not contain water-cooled tube walls; and wherein the lower furnace does not contain steam-cooled walls.

* * * * *